US008113802B2

(12) United States Patent
Liang et al.

(10) Patent No.: US 8,113,802 B2
(45) Date of Patent: Feb. 14, 2012

(54) FOOD CENTRIFUGAL PUMP FORMED BY STAMPING AND WELDING HAVING A SEAL ARRANGEMENT BETWEEN THE IMPELLER AND CASING

(75) Inventors: Yuanmin Liang, Yangjiang (CN); Dongxian Liang, Yangjiang (CN); Chunyuan Huo, Beijing (CN)

(73) Assignee: Guangdong Winning Pumps Industrial Co., Ltd., Yangjiang, Guangdong (CN)

( * ) Notice: Subject to any disclaimer, the term of this patent is extended or adjusted under 35 U.S.C. 154(b) by 815 days.

(21) Appl. No.: 12/161,215

(22) PCT Filed: Mar. 30, 2006

(86) PCT No.: PCT/CN2006/000548

§ 371 (c)(1),
(2), (4) Date: Jul. 17, 2008

(87) PCT Pub. No.: WO2007/082417

PCT Pub. Date: Jul. 26, 2007

(65) Prior Publication Data

US 2010/0247340 A1 Sep. 30, 2010

(30) Foreign Application Priority Data

Jan. 21, 2006 (CN) ..... 2006 1 0033320

(51) Int. Cl.
*F01D 5/14* (2006.01)
*F04D 29/40* (2006.01)

(52) U.S. Cl. ..... 417/423.14; 415/172.1; 415/206; 416/185; 416/197 R; 416/235; 416/236 R; 29/888.024

(58) Field of Classification Search ..... 417/423.1, 417/423.14; 29/888.024, 525.14; 415/172.1, 415/173.1, 170.1, 171.1, 206; 416/182, 185, 416/197 R, 223 B, 235, 236 R, 197 A, 197 B, 416/197 C See application file for complete search history.

(56) References Cited

U.S. PATENT DOCUMENTS 224,870 A * 2/1880 Bush ..... 416/188

(Continued)

FOREIGN PATENT DOCUMENTS

CN 87200309 U 10/1987

(Continued)

OTHER PUBLICATIONS

International Search Report issued in counterpart PCT Application No. WO 2007/082417 (with English translation) (11 pages).

*Primary Examiner* — Devon C Kramer
*Assistant Examiner* — Nathan Zollinger
(74) *Attorney, Agent, or Firm* — Wood, Herron & Evans, LLP

(57) ABSTRACT

A food centrifugal pump formed by stamping and welding, comprising a pump casing and a cover mounted therein, an impeller, a shaft and a motor provided on the outer side of the casing, wherein the impeller is mounted on the shaft and driven to rotate by the motor; the pump casing is provided with an inlet pipe and an outlet pipe; the impeller have a structure of half-opened type and consists of blades, a hub and a back cover plate, the front end of the blade is close to the inner side of the axial plane of the pump casing, and there is an end face seal formed therebetween; the pump casing is formed by stamping a single metal plate, the outer side of the axial plane of which is provided with an inlet pipe bracket used to support the inlet pipe, the end of which is connected to the outer side of the pump casing, the other end of which is nestedly connected to the inlet pipe and fixed thereon. The manufacturing process of the food centrifugal pump is simple and convenient, its cost is low, its flow rate capability is high, and the inside of the pump casing is clean.

24 Claims, 3 Drawing Sheets

U.S. PATENT DOCUMENTS

| | | | | | |
|---|---|---|---|---|---|
| 640,345 | A | * | 1/1900 | Wilberforce | 415/211.1 |
| 869,868 | A | * | 10/1907 | Spencer | 415/119 |
| RE14,988 | E | * | 11/1920 | Parsons | 415/197 |
| 1,460,160 | A | * | 6/1923 | La Bour | 415/206 |
| 1,864,834 | A | * | 6/1932 | Klosson | 416/185 |
| 2,028,783 | A | * | 1/1936 | Jacobsen | 415/198.1 |
| 2,117,011 | A | * | 5/1938 | Pratt | 415/211.1 |
| 2,291,797 | A | * | 8/1942 | Dalzell | 417/423.12 |
| 2,347,386 | A | * | 4/1944 | Adams | 415/47 |
| 2,890,660 | A | * | 6/1959 | Umbricht | 415/121.1 |
| 3,115,843 | A | * | 12/1963 | Hornschuch | 417/360 |
| 3,221,661 | A | * | 12/1965 | Swearingen | 417/370 |
| 3,272,129 | A | * | 9/1966 | Leopold | 417/350 |
| 3,801,226 | A | * | 4/1974 | Bevan et al. | 416/241 R |
| 5,040,947 | A | * | 8/1991 | Kajiwara et al. | 415/206 |
| 5,069,599 | A | * | 12/1991 | Carretta | 415/182.1 |
| 5,112,190 | A | * | 5/1992 | Kajiwara et al. | 415/215.1 |
| 5,235,744 | A | * | 8/1993 | Arakawa et al. | 29/888.02 |
| 5,310,310 | A | * | 5/1994 | Nakatsukasa et al. | 415/214.1 |
| 5,401,146 | A | * | 3/1995 | Moriya et al. | 417/423.14 |
| 5,873,698 | A | * | 2/1999 | Thalmann | 415/174.3 |
| 6,200,090 | B1 | * | 3/2001 | Chien et al. | 415/172.1 |
| 6,409,474 | B1 | * | 6/2002 | Liang | 415/204 |
| 6,551,058 | B2 | * | 4/2003 | Nowack | 415/140 |
| 6,884,032 | B1 | * | 4/2005 | Messih et al. | 415/201 |
| 2002/0187045 | A1 | * | 12/2002 | Ijima et al. | 416/223 A |
| 2003/0002985 | A1 | | 1/2003 | Tsui | |

FOREIGN PATENT DOCUMENTS

| | | | |
|---|---|---|---|
| CN | 1138670 | A | 12/1996 |
| CN | 2275169 | Y | 2/1998 |
| CN | 2355135 | Y | 12/1999 |
| CN | 1243919 | A | 2/2000 |
| CN | 2410448 | Y | 12/2000 |
| CN | 1082627 | C | 4/2002 |
| CN | 1131379 | C | 12/2003 |
| CN | 2591293 | Y | 12/2003 |
| CN | 2600618 | Y | 1/2004 |
| CN | 2809296 | Y | 8/2006 |
| EP | 0646729 | A1 | 4/1995 |
| JP | 59168297 | A | 9/1984 |
| JP | 968197 | A | 3/1997 |

* cited by examiner

FOOD CENTRIFUGAL PUMP FORMED BY STAMPING AND WELDING HAVING A SEAL ARRANGEMENT BETWEEN THE IMPELLER AND CASING

TECHNICAL FIELD OF THE INVENTION

The present invention relates to a centrifugal pump, more particular, to a food centrifugal pump for processing food formed by stamping and welding.

DESCRIPTION OF THE RELATED ART

Food centrifugal pump is a centrifugal pump product having a large market, and is widely used in industrial areas like food, beverage, beer and chemicals etc. In the prior art, the food centrifugal pump is manufactured by mean of casting. However, the casting is a process which has some disadvantages, such as high energy consuming, waste material, intensity of labor and pollution for environment. Furthermore, the pump made by casting has defects of large size, heave weight, difficulty in installation and maintaining and low efficiency etc. On the other hand, as being a kind of low-flow micro-centrifugal pump, e.g. food pump, some of components of pump can not be cast due to restriction of their structural dimension, such as an impeller which has a small flow and whose outlet has a narrow width. Therefore, the food pump formed by casting is not an ideal one at all.

A Chinese invention patent CN1082627 (App. No. 99111134.6) issued on Apr. 10, 2002 which disclosed a centrifugal pump formed by welding and punching metal plate and a method of manufacturing this pump, the centrifugal pump includes an inlet flange, an outlet flange, a rear cover, a casing and an impeller, there is a chamber between the casing and the impeller by punching, the chamber is radially outward and gradually enlarged along with direction of fluid flow, and a cross-section of which shows approximately semi-circle shape and is almost full-volute of 360 deg, furthermore, the casing also has an outlet end hole in oval shape, an outlet bend neck is communicated with and welded to the end hole, a cross-section of the outlet bend neck is communicated with and welded to the end hole, a cross-section of the outlet bend neck is an oval shape with variable diameter, a supporter of labyrinth ring is disposed in the casing. Although, this pump has advantages over the casting pumps, it is easy to have the impeller blocked during fluid flowing therein while the fluid is thick, due to a closed structure impeller, the passability of which is unacceptable; on the other hand, it can block the flow of fluid and make the fluid passing the casing not sanitary due to the bracket inside of the casing. Hence, this type of pump is not suitable to be used as a food pump.

SUMMARY OF THE INVENTION

The present invention is directed to solve the foregoing problems existing in the prior art, accordingly, provides a food centrifugal pump which has the advantages of simple manufacture process, low cost, excellent fluid passablity and sanitary.

According to the present invention, there is provided a food centrifugal pump formed by stamping and welding, comprising a pump casing, a cover, an impeller, a shaft which is mounted in said pump casing, and a motor provided on the external of the casing, said impeller is mounted on the shaft and driven to rotate by the motor; the pump casing is provided with an inlet pipe and an outlet pipe, the impeller having a structure of half-opened type and consisting of blades, a hub and a back cover plate, the front ends of said blades is proximate to the inner side of the axial plane of said pump casing, and form end surface seal thereof; the pump casing is formed by stamping a single metal plate, a bracket for supporting the inlet pipe is provided on the outer side of the axial plane of the casing, one end of said bracket is connected to the outer side of the pump casing, the other end is engaged over and fixed on the inlet pipe.

The food centrifugal pump formed by stamping and welding according to the present invention also has additional technical characters as following:

Said blades have an integrated structure of two in one, the adjacent two said blades are manufactured from one piece of metal plate by stamping, and forming a blade body having a cross section of U-shape.

Each of said blades in radial direction consists of two segments circular arc with interiorly tangent.

Said bracket is a truncated cone in overall shape, the diameter thereof gradually increasing from front to rear, said bracket comprises a conical main body, a rear end wall integrated with said main body, a front end wall and a peripheral wall externally extending outwards from said front end wall; said rear end wall welded to the axially outer surface of said pump casing, said peripheral wall engaged over and welded to an external of the front end of said inlet pipe.

Said rear end wall is a vertical wall, and closely contacted and welded together with a vertical wall of the axial plane of said pump casing. The intermediate portion of the axial plane of said pump casing caved inwardly, so as to form a peripheral wall, an inclined wall and a middle wall connecting said inclined wall and said vertical wall in the middle of the axial plane; said peripheral wall engaged over and welded to the external of the rear end of said inlet pipe.

A width of inlet of said blades is greater than an outlet's width thereof, so as to form a sloping edge with an angle $\alpha$ in the front end of said blades; an obliquity angle $\beta$ of said inclined wall equal to said obliquity a, so as to form said end face seal. A clearance between the front end of said blade and said inclined wall is less than 2 mm.

The radial plane of said casing is cylindrical, and a tongue is disposed adjacent to said outlet pipe in said radial plane, and a discharge hole is disposed on the lowest end of said casing.

Said electrical motor is fixed on said casing by mean of a bracket, a front end of middle portion of said bracket formed a supporting structure for rigidly supporting said cover.

The food centrifugal pump formed by stamping and welding according to the present invention, firstly due to the food centrifugal pump of the present invention adopts the process of stamping and welding (wherein the main components thereof, such as the casing, the cover, the impeller, the bracket for inlet pipe, are formed by stamping and connected together by welding), it has a simple and convenient process for forming if comparing with the casting pump, so that it not only reduces the manufacture cost, but also to overcome their defects, such as pollution, high power and material consumed in casting etc.; secondly, because the pump adopts the impeller with half-opened structure, it has better fluid passability than impellers with closed structure, so that the fluid is not easily blocked during passing the impeller, even if the fluid is thick. Therefore, the food centrifugal pump is adapted to be used in multiple operation situations, to pump different kinds of liquid food and to work in reliable and efficient condition; thirdly, because the bracket of the inlet pipe is disposed on the external of the casing, not in its interior, hence, it makes more sanitary the inside of the casing and ensures the quality of the food.

BRIEF DESCRIPTION OF THE DRAWINGS

These and other aspects and advantage of the invention will become apparent and more readily appreciated from the following descriptions taken in conjunction with the drawings in which.

DETAILED DESCRIPTION OF EMBODIMENTS OF THE IVENTION

Figure 1:
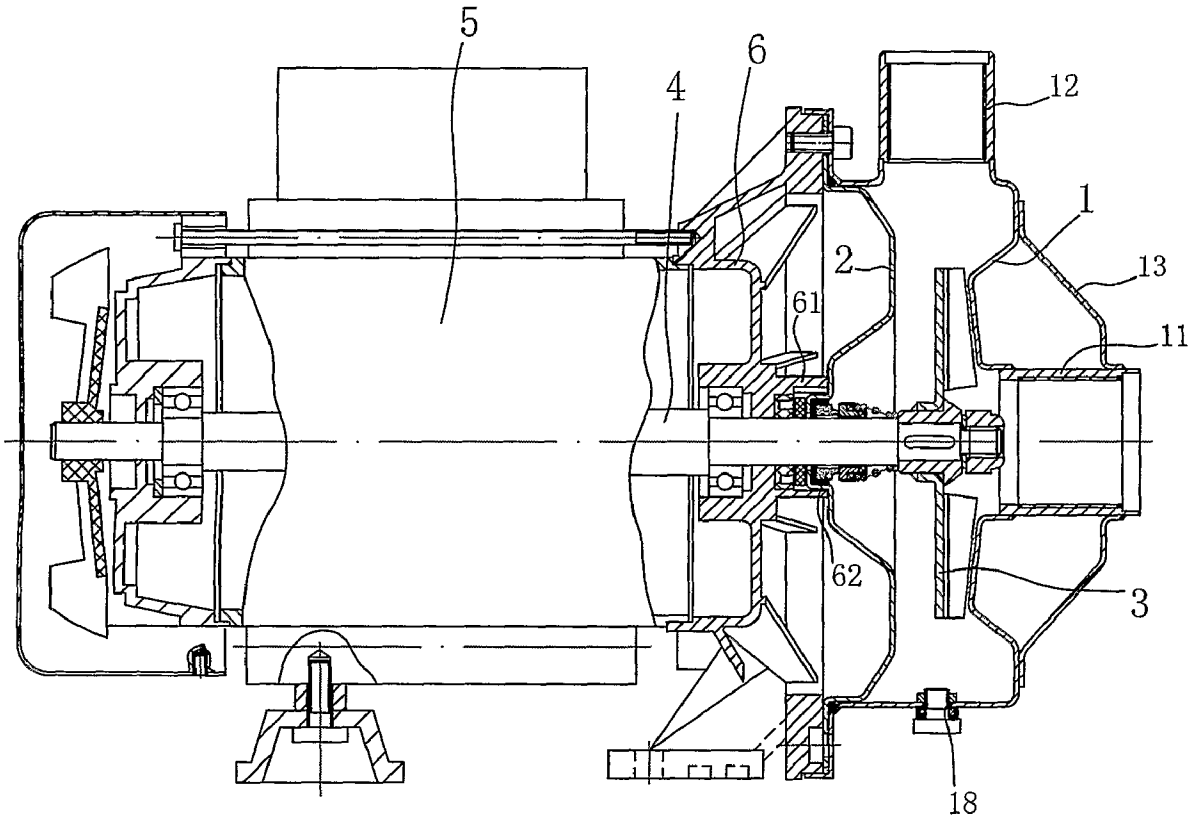
FIG. 1 is a front view of the food centrifugal pump according to the present invention, wherein a partial section view is adapted to show the interior structure thereof.

As shown in FIG. 1, the food centrifugal pump according to the present invention, comprises a pump casing 1, a cover 2 mounted inside of said pump casing 1, an impeller 3, a shaft 4, and a motor 5 provided on the external of the casing 1, said impeller 3 is mounted on the shaft 4 and driven to rotate by the motor 5; the pump casing 1 is provided with an inlet pipe 11 and an outlet pipe 12. Because the food centrifugal pump of the present invention adopts the process of stamping and welding (i.e. the main components, such as the casing, the cover, the impeller, the bracket for inlet pipe, are formed by stamping an connected together by welding), it has a simple and convenient process for forming compared with the casting pump, so that it not only reduces the manufacture cost, but also to overcome their defects, such as pollution, high power and material consumed in casting etc.

It is also shown in FIG. 1, the electrical motor 5 is fixed to the casing 1 via a bracket 6, a front end of middle portion of said bracket 6 forms a supporting structure 61 for rigidly supporting said cover 2. Due to the rigidly supporting of said supporting structure 21 for said cover 2, the rigidity of the cover 2 is improved dramatically, to prevent or greatly decrease the possibility of deformation of the cover under a condition of high pressure and temperature, consequently ensure the reliability of the mechanical seal 62 in operation.

Referring to FIG. 1, the casing 1 is made of an entire metal plate by punching, a bracket 13 supporting the inlet pipe 11 provided on the outer side of the axial plane of which, one end of said bracket 13 is connected to the outer side of the pump casing 1, the other end of which is engaged over and fixed on the inlet pipe 11. Because the bracket for the inlet pipe is disposed on external of the casing, but not its interior, the obstacle of fluid caused by the external casing is reduced and makes more sanitary the inside of the casing and ensures the quality of the food.

Figure 2:
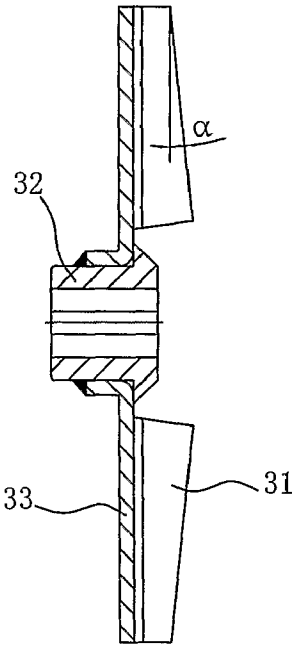
FIG. 2 is an enlarged section view of the impeller of the food centrifugal pump.

As shown in FIG. 1 and FIG. 2, the impeller 3 has a structure of half-opened type and consists of blades 31, a hub 32 and a back cover plate 33, the front ends of said blades are close to the inner side of the axial plane of said pump casing 1, and there is an end surface seal formed therebetween. Compared with the impeller having closed structure, the impeller having the half-opened structure not only removes a front cover, so as to reduce the cost, but also improves the passability of fluid, and it is less likely to block even thick liquid passing the impeller. Therefore, the food centrifugal pump is adapted to be used in multiple operation situations, to pump different kinds of liquid food and to work in reliable and efficient condition.

Figure 3B:
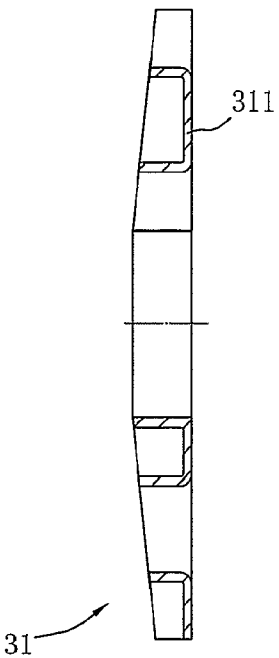
FIG. 3B is a cross-sectional view of along line B-B in FIG. 3A, it illuminates the two in one integrated type structure of the blades.
Figure 3A:
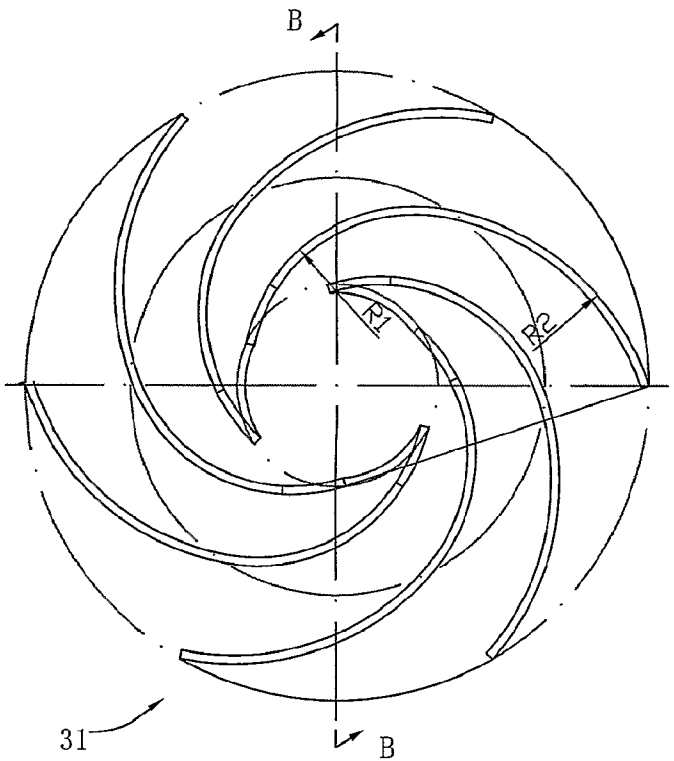
FIG. 3A is a front view of the structure of the impeller's blades in FIG. 2, the number and distributions of the blades are illuminated.

As shown in FIGS. 3A and 3B, in a preferred embodiment of the present invention, the blades 31 are an integrated structure of two in one, two adjacent said blades 31 are manufactured from one piece of metal plate by stamping, and form a blade body having a cross section in U-shape. Such structure of the blade can dramatically increase the rigidity and strength of half-opened impeller, so as to increase the reliability thereof in operation; on the other hand, a flat wall 311 can be joined to the back cover plate 33 is formed at the bottom between the two blades 31, hence, the blades 31 can be easily welded to the back cover plate 33, and the welded connection is very strong.

As shown in FIG. 3A, each of said blades 31 in radial direction consists of two segments circular arc with interiorly tangent. Such structure results in efficient energy conversion with blades 31.

Figure 4:
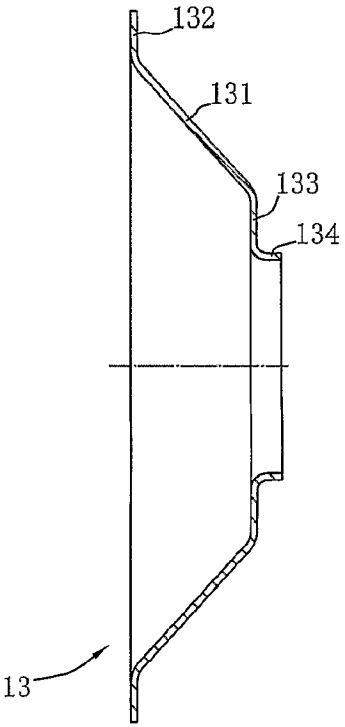
FIG. 4 is an enlarged view of the bracket for outlet pipe of the food centrifugal pump.
Figure 5:
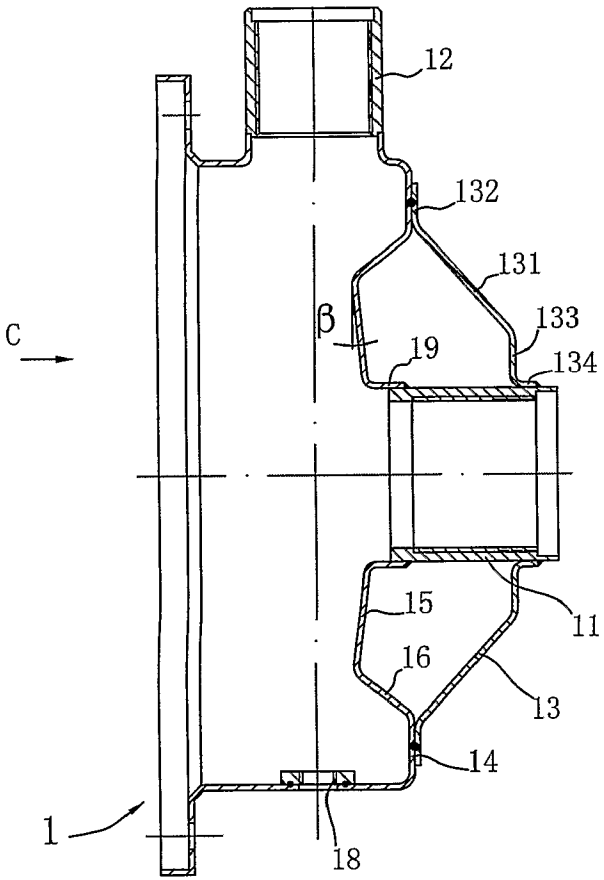
FIG. 5 is an enlarged view of the casing of the food centrifugal pump in FIG. 1, in order to make clear, the bracket for the inlet pipe fixed to the casing is also shown.

As shown in FIGS. 4 and 5, in another preferred embodiment of the present invention, the bracket 13 is a truncated cone in overall shape, the diameter thereof gradually increasing from front to rear, the bracket 13 comprises a conical main body 131, a rear end wall 132 integrated with said main body 131, a front end wall 133 and a peripheral wall 134 externally extending from said front end wall 133; said rear end wall 132 is welded to the axially outer surface of said pump casing 1, said peripheral wall 134 is engaged over and welded to an external of the front end of the inlet pipe 11. The structure form of the bracket 13 ensures the rigidity and strength thereof, and increases the rigidity and strength of the casing 1 as well.

As shown in FIG. 5, the rear end wall 132 is a vertical wall (which is vertical to the axis of the casing), and is closely contacted with a vertical wall 14 of the axial plane of said pump casing 1 and welded together. The two vertical walls are contact welded, and there is enough contacting area between them so as to ensure the reliability of welding.

As shown in FIG. 1 to FIG. 5, the middle portion of the axial plane of the pump casing 1 is caved inwardly, so as to form a peripheral wall 19, an inclined wall 15 and a middle wall 16 connecting the inclined wall 15 to the vertical wall 14 in the middle of the axial plane; the peripheral wall 19 is engaged over and welded to the external of the rear end of the inlet pipe 11. As shown in FIG. 5, the peripheral wall 19, inclined wall 15 and the middle wall 16 form a structure having a substantial U-shape cross-section, such concave-convex structure is adapted to enormously increase the rigidity and strength of the casing 1, and is also good to match with the front end of the impeller 3.

As shown in FIG. 2, a width of inlet of the blades 31 is greater than an outlet width thereof, so as to form a sloping edge having an obliquity angle $\alpha$ in the front end of the blades; an obliquity angle $\beta$ of the inclined wall 15 is equal to the obliquity angle $\alpha$, so as to form the end surface seal, a clearance between the front end of the blade 31 and the inclined wall 15 is less than 2 mm. Hence, the good seal between the blades 31 and the inclined wall 15 is achieved, so as to prevent the leakage of the liquid.

Figure 6:
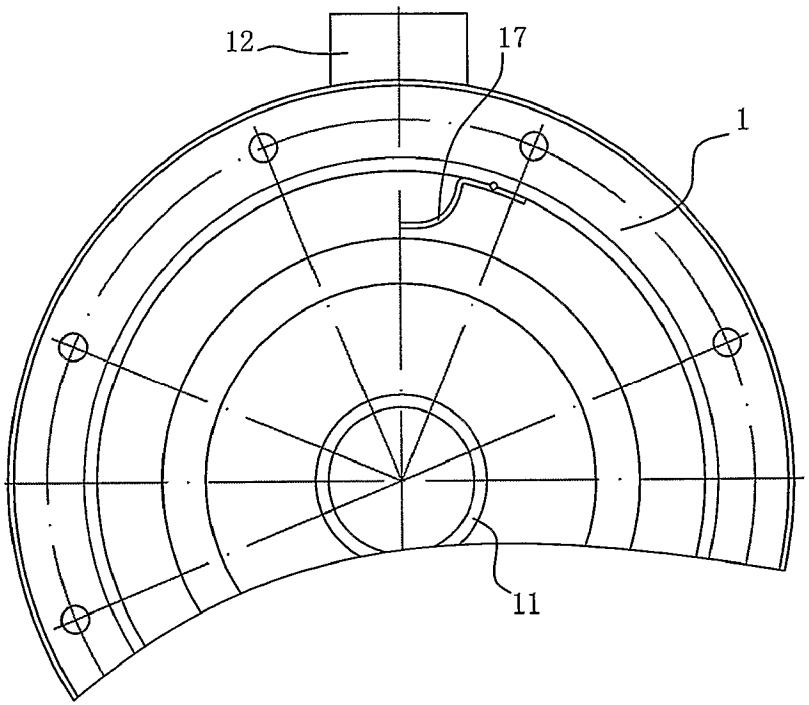
FIG. 6 is view of C direction in FIG. 5; it shows the installation location of the tongue.

As shown in FIG. 6, the radial plane of said casing 1 is cylindrical, and a tongue 17 which is adapted to enhance the hydraulic performance of the pump is disposed adjacent to the outlet pipe in said radial plane. A discharge hole 18 is disposed at the lowest end of said casing 1, in the operation, the discharge hole 18 is blocked by a screw, as shown in FIG. 6, when the rest liquid is needed to be discharged from the casing 1, remove the screw, then discharging the liquid by the discharge hole.

Because the food centrifugal pump of the present invention is made of a single metal plate by stamping and welding, thereby it overcomes the defects of high consuming power and material, intensity of labor, pollution for environment and complex installation and maintaining of the casting pump, and it also provides virtues of rational structure, good rigidity and strength, high efficiency and excellent passability. The weight of which is merely ¼ of weight of the same kind of the casting pump, and the cost thereof is only ⅔ is of the casting one, however, the efficiency thereof is higher 5-7% than the casting one.

Although explanatory embodiments have been shown and described, it would be appreciated by those skilled in the art that changes, alternatives, and modifications can be made in the embodiments without departing from spirit and principles of the invention. Such changes, alternatives, and modifications all fall into the scope of the claims and their equivalents.

What is claimed:

1. A food centrifugal pump formed by stamping and welding, comprising:

a pump casing having an annular inclined wall and formed from a single metal plate by stamping;

an inlet pipe and an outlet pipe connected with the pump casing;

a cover mounted inside of the pump casing;

a bracket for supporting the inlet pipe and provided on an outer side of the pump casing, wherein one end of said bracket is connected to the pump casing and the other end is engaged over and fixed onto the inlet pipe;

an impeller;

a shaft; and a motor provided external to the casing; wherein said impeller is mounted on the shaft and is driven to rotate by the motor, the impeller having a half-open type structure comprising blades, a hub, and a back plate upon which the blades are connected; wherein a front portion of said blades is located proximate to an inner side of the annular inclined wall so as to form an end face seal between the inclined wall and the blades; and wherein each blade is formed from a single metal piece so as to possess a U-shaped cross section defining a yoke and a pair of spaced-apart legs, the yoke being secured to the back plate and the legs extending perpendicular to the yoke so as to form an open channel, wherein the legs extend radially outward along circular arc paths from an interior portion of the back plate towards an outer circumference of the back plate, the spacing between the pair of legs on each blade being greatest near the outer circumference; and wherein an outer portion of each leg is located proximate to the annular inclined wall and slopes obliquely at an angle $\alpha$, which angle is equal to an obliquity angle $\beta$ of the annular inclined wall so as to form the end face seal.

2. A food centrifugal pump comprising:

a single-piece pump casing having a first inlet pipe opening along an axis of the casing, an outlet pipe opening, and a cover opening, the casing also including an annular inclined wall adjacent to the first inlet pipe opening and extending to the first inlet pipe opening obliquely at an angle $\beta$;

a cover mounted in the cover opening;

a single-piece bracket having a second inlet pipe opening along an axis of the bracket, the bracket being secured to the casing outside of the first inlet pipe opening, the second inlet pipe opening aligned with the first inlet pipe opening;

a separate inlet pipe secured to the first inlet pipe opening, the inlet pipe extending through and secured to the second inlet pipe opening;

a separate outlet pipe secured to the outlet pipe opening;

a motor and a shaft extending from the motor through the cover and into the casing; and an impeller supported for rotation in the casing on the shaft, the impeller having a back plate and a plurality of single-piece blades, each blade having a U-shaped cross section defining a yoke and a pair of spaced-apart legs, the yoke being secured to the back plate and the legs extending perpendicular to the yoke so as to form an open channel, wherein the legs extend radially outward along circular arc paths from an interior portion of the back plate towards an outer circumference of the back plate, the spacing between the pair of legs on each blade being greatest near the outer edge, and wherein an outer edge of each leg slopes obliquely at an angle $\alpha$ equal to the angle $\beta$, the legs being in close proximity to the annular wall to define an end surface seal between the impeller and the annular inclined wall.

3. A method of making a food centrifugal pump comprising:

forming a casing by stamping a single metal plate so as to have a first inlet pipe opening along an axis of the casing, an outlet pipe opening, a cover opening, and an annular wall adjacent to the first pipe opening, the annular wall extending to the first inlet pipe opening obliquely at an angle $\beta$;

welding an inlet pipe to the first inlet pipe opening;

welding an outlet pipe to the outlet pipe opening;

forming a bracket by stamping a single metal plate so as to have a second inlet pipe opening along an axis of the bracket;

mounting the bracket to the casing with the inlet pipe extending through the second inlet pipe opening;

welding one end of the bracket to the casing outside of the first inlet pipe opening;

welding the second inlet pipe opening to the inlet pipe;

forming a plurality of blades by stamping a plurality of single metal plates, each blade having a U-shaped cross section defining a yoke and a pair of spaced-apart legs, each leg extending from one end of the blade and extending along a circular arc path towards an opposite end, the spacing between the leg pair on each blade being greatest at the opposite end, and wherein an outer edge of each leg slopes obliquely at an angle $\alpha$ equal to the angle $\beta$;

welding the yoke of each blade to an impeller back plate with the legs extending perpendicular to the yoke so as to form an open channel;

mounting the impeller back plate to a shaft of a motor; and mounting the motor with the casing with the outer edge of each leg in close proximity to the annular wall to define an end surface seal between each leg and the annular wall.

4. The food centrifugal pump formed by stamping and welding of claim 1, wherein the legs of each blade intersect at an interior portion of the back plate.

5. The food centrifugal pump of claim 2, wherein the legs of each blade intersect at an interior portion of the back plate.

6. The method of claim 3, wherein the legs of each blade intersect at an interior portion of the back plate.

7. A food centrifugal pump formed by stamping and welding of claim 1, wherein said bracket is a truncated cone in overall shape, the diameter thereof gradually increasing from front to rear, said bracket comprising a conical main body, a rear end wall integrated with said main body, a front end wall and a peripheral wall externally extending from said front end wall; said rear end wall welded to the axially outside surface of said pump casing, said peripheral wall engaged over and welded to an external portion of the front end of said inlet pipe.

8. A food centrifugal pump formed by stamping and welding of claim 7, wherein said rear end wall is a vertical wall, and is closely contacted with and welded to a vertical wall of the axial plane of said pump casing.

9. A food centrifugal pump formed by stamping and welding of claim 8, wherein a middle portion of the axial plane of said pump casing caves inwardly, so as to form a peripheral wall, an inclined wall and a middle wall connecting said inclined wall to said vertical wall in the middle of the axial plane; said peripheral wall engaged over and welded to an external portion of the rear end of said inlet pipe.

10. A food centrifugal pump formed by stamping and welding of claim 1, wherein a clearance between the front end of said blades and said inclined wall is less than 2 mm.

11. A food centrifugal pump formed by stamping and welding of claim 1 wherein said casing is cylindrical in the radial plane, and a tongue is disposed adjacent to said outlet pipe in said radial plane.

12. A food centrifugal pump formed by stamping and welding of claim 1 wherein a discharge hole is disposed at the lowest end of said casing.

13. A food centrifugal pump formed by stamping and welding of claim 1 wherein said motor is fixed on said casing by a motor bracket, and a front end middle portion of said motor bracket forms a supporting structure for rigidly supporting said cover.

14. The food centrifugal pump of claim 2, each blade having two segments being internally tangent in a radial direction.

15. The food centrifugal pump of claim 2, the blade edges being spaced from the annular wall less than 2 mm.

16. The food centrifugal pump of claim 2, the casing further comprising a tongue adjacent to the outlet pipe opening.

17. The food centrifugal pump of claim 2, the casing further including a discharge hole.

18. The food centrifugal pump of claim 2, further comprising second bracket securing the motor to the casing.

19. The method of claim 3 further comprising mounting a cover in the cover opening.

20. The method of claim 3 further comprising mounting a hub to the impeller back plate, mounting the impeller back plate to the shaft including securing the hub to the shaft.

21. The method of claim 3, wherein forming the blades including stamping the plates so that each blade has two segments being internally tangent in a radial direction.

22. The method of claim 3 further comprising positioning the impeller back plate such that the blade edges are spaced from the annular wall less than 2 mm.

23. The method of claim 3 wherein forming the casing includes defining a discharge hole.

24. The method of claim 3 wherein mounting the motor to the casing includes securing a second bracket associated with the motor to the casing.

* * * * *